US006840223B2

(12) United States Patent
Fukuhara

(10) Patent No.: US 6,840,223 B2
(45) Date of Patent: Jan. 11, 2005

(54) ARMATURE AND ARMATURE DRIVING DEVICE

(75) Inventor: Kazuyuki Fukuhara, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/382,575

(22) Filed: Mar. 7, 2003

(65) Prior Publication Data

US 2003/0178006 A1 Sep. 25, 2003

(30) Foreign Application Priority Data

Mar. 20, 2002 (JP) ..... 2002-079266

(51) Int. Cl.[7] ..... F02M 55/02; F02M 51/00

(52) U.S. Cl. ..... 123/458; 123/506; 251/129.11; 251/129.15; 335/251; 335/272

(58) Field of Search ..... 123/447, 506, 123/456, 457, 458, 467; 335/251, 261; 251/129.11, 129.15, 129.16, 129.18

(56) References Cited

U.S. PATENT DOCUMENTS 5,753,212 A * 5/1998 Pescatore et al. ..... 424/65
6,206,342 B1 * 3/2001 Beck ..... 251/129.11
6,349,703 B1 2/2002 Rapp ..... 123/458
6,408,824 B1 6/2002 Pacucci et al. ..... 123/467
6,508,418 B1 * 1/2003 Fochtman et al. ..... 239/585.4

FOREIGN PATENT DOCUMENTS

| | | |
|---|---|---|
| JP | 03156164 | 7/1991 |
| JP | 07224960 | 8/1995 |
| JP | A 10-246169 | 9/1998 |
| JP | A 11-229999 | 8/1999 |
| JP | 2000146007 | 5/2000 |
| JP | A 2001-59459 | 3/2001 |
| JP | A 2001-132578 | 5/2001 |
| JP | 2001248521 | 9/2001 |
| JP | WO 03/048558 A1 | 6/2003 |

* cited by examiner

*Primary Examiner*—Weilun Lo
(74) *Attorney, Agent, or Firm*—Oliff & Berridge, PLC

(57) ABSTRACT

This invention is an armature and an armature driving device in which the armature is rotated around its axis so as to inhibit uneven wear from occurring between the armature and a housing. That is, an armature which is slidably provided within a housing filled with fluid and which divides the inside of the housing into two fluid chambers is further provided with a communicating hole that enables the fluid to pass between the two fluid chambers. This communicating hole is formed such that the fluid passing through the communicating hole and out from the armature when the armature slides flows out at an angle to, and to the side of, a center axis of the armature.

10 Claims, 8 Drawing Sheets

ARMATURE AND ARMATURE DRIVING DEVICE

INCORPORATION BY REFERENCE

The disclosure of Japanese Patent Application No. 2002-079266 filed on Mar. 20, 2002, including the specification, drawings and abstract is incorporated herein by reference in its entirety.

BACKGROUND OF THE INVENTION

1. Field of the Invention

The invention relates to an armature used in an electromagnetic valve or the like, and an armature driving device.

2. Description of the Related Art

In the past, a metering valve has been provided in a fuel supply systems for an internal combustion engine, for example, to regulate the fuel quantity sent to the internal combustion engine. This metering valve includes a valve body provided in a fuel passage through which fuel flows, and an actuator that changes the fuel flow area of the passage by displacing the valve body.

For this type of actuator, it is conceivable to use an actuator such as that proposed in Japanese Patent Laid-Open Publication No. 10-246169, for example, i.e., an actuator that moves an armature, which is of magnetic material and which is coupled to a valve body so that it can move together with the valve body, in a reciprocating manner by electromagnetic force. A metering valve to which such an actuator has been applied will be described with reference to FIGS. 12 to 14.

FIG. 12 is an expanded cross-sectional view showing a part of the actuator in the metering valve. As shown in the figure, an actuator 91 is provided with a cylindrical armature 93 in a housing 92 of the actuator 91, and an electromagnetic solenoid 94 for imparting an electromagnetic force on the armature 93. The armature 93 is coupled to a shaft 95 that passes through the housing 92 and into a fuel passage 96. The armature 93 is also coupled to a valve body, not shown, in the fuel passage 96 via this shaft 95.

The armature 93, the shaft 95, and the valve body are all positioned on the same axis, and are energized in the direction in which the shaft 95 enters the housing 92 by a spring, not shown, provided on the fuel passage 96 side. Further, the armature 93 is slid in the direction that the shaft 95 protrudes from the housing 92 against the spring force of the spring by electromagnetic force generated when the electromagnetic solenoid 94 is energized. As the armature 93 slides, it displaces the valve body in the fuel passage 96 such that the fuel flow area in the fuel passage 96 changes. When the electromagnetic solenoid 94 is de-energized, the spring force of the spring keeps the valve body in a position in which the fuel flow area in the fuel passage 96 is greatest (i.e., in a fully open position).

Also, the fuel in the fuel passage 96 is sent, through a portion through which the shaft 95 passes, into the housing 92 to provide lubrication. Therefore, the housing 92 fills up with fuel which lubricates a small gap $\delta$ between the armature 93 and the housing 92 when the armature 93 slides. When the spaces on both sides in the axial direction of the armature 93 inside the housing 92 are filled with fluid, however, that fluid impedes the sliding of the armature 93 in the axial direction.

To prevent this, a communicating hole 99 extending parallel with the shaft 95 is formed in the armature 93 to provide communication between the two fluid chambers 97 and 98. This communicating hole 99 enables fuel to pass between the two fluid chambers 97 and 98 as the armature 93 slides, thereby minimizing the chance of the fuel in the fluid chambers 97 and 98 impeding the movement of the armature 93 in the axial direction. FIG. 13 is a cross-sectional view of the armature 93 in the radial direction, and FIG. 14 is a cross-sectional view of the armature 93 shown in FIG. 14 as viewed from the direction of arrow A—A.

Forming the communicating hole 99 in the armature 93 as described above makes it possible to minimize the resistance from the fluid inside the fluid chambers 97 and 98 that is generated when the armature 93 slides in the axial direction.

However, in the aforementioned publication, no consideration is given to rotating the armature 93 around its axis. Therefore, it is implausible that the armature 93 would rotate around its axis on its own. Accordingly, the same portions of the armature 93 and the housing 92 would always slide against one another when the armature 93 slides in the axial direction.

In many cases, the sliding surface of the armature 93 in the housing 92 is coated with a coating to reduce friction during sliding. However, when the same portions of the armature 93 and the housing 92 always slide against one another, the coating on those portions may peel off.

If this happens, the coating material that has peeled off may wear down the sliding surface of the housing 92 in the armature 93 at, for example, the hatched portion C in FIG. 12 when the armature 93 slides in the axial direction while that peeled-off coating material is between the armature 93 and the housing 92.

SUMMARY OF THE INVENTION

In view of the foregoing problems, it is an object of this invention to provide an armature and an armature driving device that rotates the armature around its axis so as to be able to inhibit uneven wear from occurring between the armature and a housing.

According to a first aspect of the invention, an armature which is slidably provided within a housing filled with a fluid and which divides an inside of the housing into two fluid chambers, is provided with a communicating hole enabling the fluid to pass between the two fluid chambers. This communicating hole is formed such that the fluid passing through the communicating hole and out from the armature when the armature slides flows out at an angle to, and to the side of, a center axis of the armature.

According to this aspect of the invention, the flow of fluid passing through the communicating hole and out from the armature when it slides generates a force that acts on the armature in a direction of rotation around its axis. This force in the direction of rotation acts on the armature so that it rotates around the center axis. Accordingly, uneven wear between the armature and the housing due to the same portion of the armature always sliding against the same portion of the housing when the armature is driven, is able to be minimized.

Further, at least one end portion of the communicating hole may be a portion that extends at an angle to, and to the side of, the center axis of the armature. Therefore, when the fluid passes through the one end portion of the communicating hole and flows out of the armature when the armature is slid, that fluid properly flows out at an angle to, and to the side of, the center axis of the armature so as to impart the proper force on the armature in the direction of rotation around its axis.

Moreover, the one end portion of the communicating hole may open to the fluid chamber on the one end portion side.

With this construction, the fluid passes smoothly through the one end portion of the communicating hole and flows out from the armature when the armature is slid, thereby increasing the force of the fuel passing through the communicating hole. As a result, the fluid flowing out from the armature increases the force in the direction of rotation acting on the armature.

Still further, a portion of the communicating hole on the side of the other end portion, with respect to the one end portion, may extend parallel to the center axis of the armature and open to a fluid chamber on the other end portion side. With this construction, when the armature is slid in the axial direction, the fluid flows smoothly into the portion of the communicating hole extending parallel to the center axis of the armature, and flows out from the armature through the end portion of the communicating hole. Because the force of the fluid passing through the communicating hole increases due to the fluid smoothly flowing into the communicating hole, the outflow of the fluid from the armature increases the force in the direction of rotation acting on the armature.

Also, the communicating hole may be formed such that the center of the armature is positioned on the center axis of the armature. With this construction, the outflow of the fluid passing through the communicating hole smoothly rotates the armature around its axis, and the armature is able to be rotated with very little force.

Also, the communicating hole may be formed in a plurality, and having the same shape, at equidistant intervals around the center axis of the armature. This enables the center of the armature to be easily positioned on its center axis, and the armature is easily able to be rotated on its axis from the outflow of fluid from the plurality of communicating holes in the armature when the armature is slid.

In addition, at least one end portion of the communicating hole may be formed bent and extending at a right angle to, and to the side of, the center axis of the armature, and this one end portion may open to the fluid chamber on the one end portion side.

According to a second aspect of this invention, a driving device for an armature that is slidably provided within a housing filled with a fluid and that divides an inside of the housing into two fluid chambers in the housing, which slides the armature by electromagnetic force generated by energizing an electromagnetic solenoid, is provided with a communicating hole in the armature that enables the fluid to pass between the two fluid chambers, and a control portion that changes an amount of current supplied to the electromagnetic solenoid. The communicating hole is formed such that the fluid passing through the communicating hole and out from the armature when the armature slides flows out at an angle to, and to the side of, a center axis of the armature. The control portion changes the amount of current supplied to the electromagnetic solenoid at a first predetermined timing and imparts a force to the armature which is based on the outflow of the fluid, and which is able to rotate the armature in the direction of rotation around its center axis.

According to this aspect of the invention, when the armature is slid, the fluid passing through the communicating hole flows out from the armature such that a force acts on the armature in the direction of rotation around its axis. With this construction, when the armature starts to be driven or when the armature stops being driven, it is slid such that the force in the direction of rotation becomes a value enabling the armature to rotate around its axis such that it rotates around its axis. Accordingly, uneven wear between the armature and the housing due to the same portion of the armature always sliding against the same portion of the housing is able to be minimized.

Also, the first predetermined timing may be when the armature starts to be driven. Further, the first predetermined timing may be when the armature stops being driven. Still further, the change in the amount of current supplied to the electromagnetic solenoid at the first predetermined timing may be larger than a difference between an upper limit value and a lower limit value of a control range of the amount of current between the time when the armature starts to be driven and the time when the armature stops being driven.

Accordingly, if the armature rotates around its axis when it is being driven, i.e., when the armature is being moved (i.e., slid) in the axial direction between the time when the armature starts to be driven and the time when the armature stops being driven, the armature would rotate as it moved. As a result, there is a possibility that friction from the rotation would have an adverse effect on the control of movement of the armature in the axial direction. According to this construction, however, the change in the current to the electromagnetic solenoid between the time the armature starts to be driven and the time the armature stops being driven is less than the change in the current at the time the armature starts to be driven and stops being driven. It is therefore possible to rotate the armature only when changing the current when the armature starts to be driven and stops being driven, and keep the armature from rotating when there is a change in the current between the time when the armature starts to be driven and the time when the armature stops being driven, thereby inhibiting the aforementioned problem from occurring.

Further, the armature may have a metering valve provided in a fuel supply system of an internal combustion engine. Moreover, the control portion may control the amount of current supplied to the electromagnetic solenoid within the control range when the internal combustion engine is running, and make the change in the amount of current supplied to the electromagnetic solenoid larger than the difference between the upper limit value and the lower limit value of the control range at a second predetermined timing. In addition, the second predetermined timing may be at the beginning of startup of the internal combustion engine when an ignition switch is turned on. Still further, the second predetermined timing may be at the beginning of shutdown of the internal combustion engine when an ignition switch is turned off.

Accordingly, if the armature is rotated around its axis when the engine is running and the armature of the metering valve for metering the fuel quantity is moved (i.e., slid) in the axial direction, the armature would rotate as it moved. As a result, there is a possibility that friction from the rotation would have an adverse effect on the control of movement of the armature in the axial direction. According to the foregoing construction, however, it is possible to rotate the armature around its axis only when the fuel flow quantity is not being metered by the metering valve as the armature slides, such as at the beginning of engine startup or at the beginning of engine shutdown, so that the aforementioned problem does not occur.

DETAILED DESCRIPTION OF THE PREFERRED EMBODIMENTS

Hereinafter, one exemplary embodiment of the invention that has been applied to a metering valve for regulating a fuel flow quantity which is provided in a fuel supply system of a diesel engine mounted in a vehicle will be described with reference to FIGS. 1 to 5.

Figure 1:
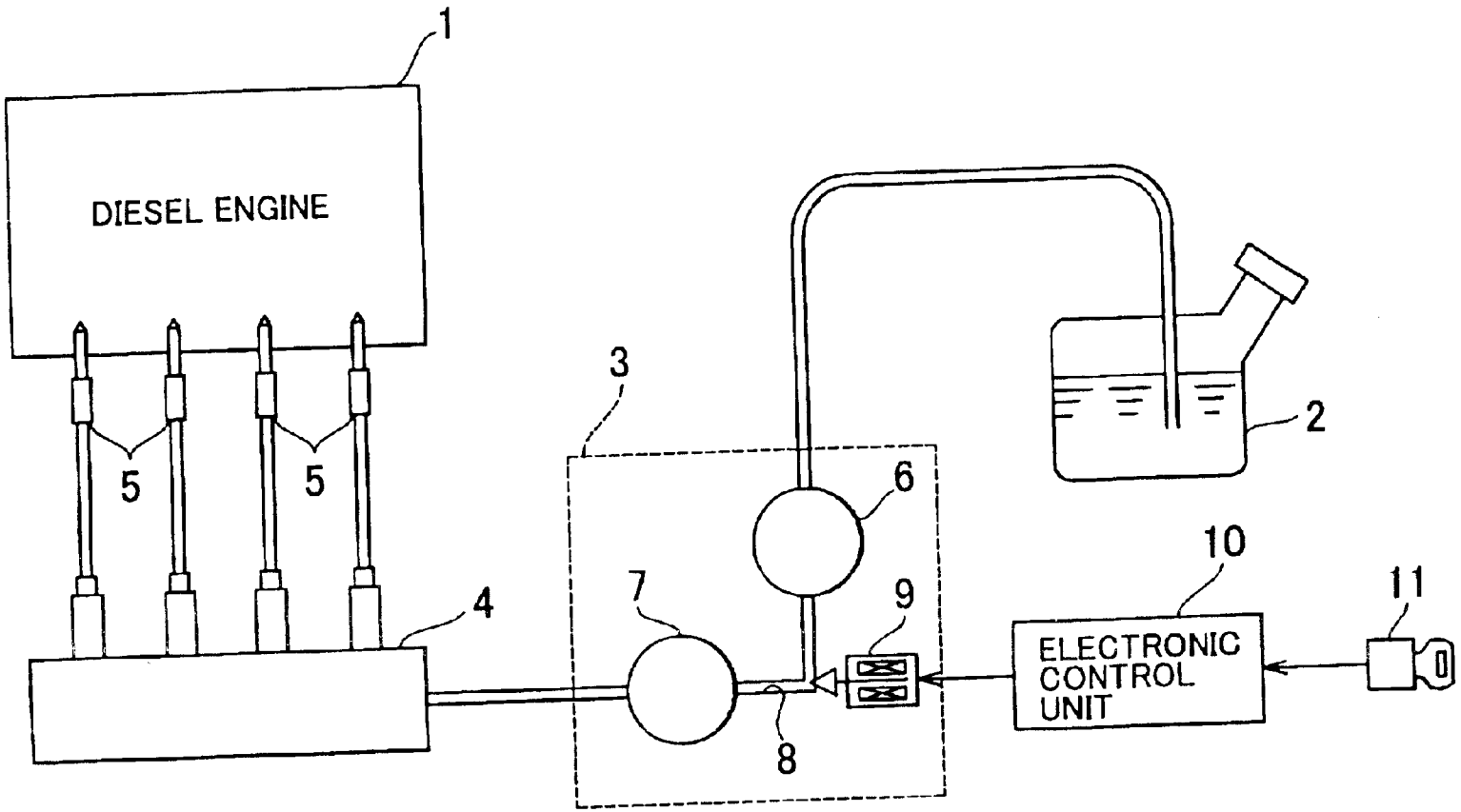
FIG. 1 is a schematic view showing a fuel supply system of a diesel engine provided with a metering valve to which the invention is applied.

FIG. 1 is a view schematically showing a fuel supply system of a diesel engine 1. In this fuel supply system, fuel from a fuel tank 2 is drawn into a supply pump 3 where it is pressurized and sent to a common rail 4 as high pressure fuel. The high pressure fuel in the common rail 4 is supplied to a fuel injection valve 5 of the diesel engine 1, and injected into a combustion chamber of the diesel engine 1 by driving the fuel injection valve 5. In this diesel engine 1, the amount of fuel discharged from the supply pump 3 is adjusted so as to achieve a predetermined pressure within the common rail 4. The idle speed and engine output are adjusted by changing the fuel quantity injected by the fuel injection valve 5.

The supply pump 3 is provided with a feed pump 6 that draws in fuel from the fuel tank 2, a plunger pump 7 that pressurizes the fuel drawn by the feed pump 6, and a metering valve 9 that meters the fuel flow quantity in a fuel passage 8 through which the fuel is sent from the feed pump 6 to a plunger pump 7.

The metering valve 9 is controlled by an electronic control unit (hereafter referred to as "ECU") 10 mounted in the vehicle so as to meter the fuel flow quantity in the fuel passage 8 to achieve a predetermined pressure within the common rail 4. This ECU 10 receives signals from an ignition switch 11 operated by a driver when beginning startup and shutdown of the diesel engine 1.

Here, the internal construction of the metering valve 9 will be described in detail with reference to FIG. 2. As shown in the figure, the metering valve 9 includes a valve body 12 provided in the fuel passage 8 and an actuator 13 which displaces the valve body 12 to change the fuel flow area in the fuel passage 8.

A cylindrical armature 15 of magnetic material is provided slidable in an axial direction (in the left-right direction in the figure) thereof, in a housing 14 of the actuator 13. The armature 15 is coupled with a shaft 16 that extends along the same axis as the center axis L of the armature 15 and abuts against the valve body 12. The armature 15, the shaft 16, and the valve body 12 are energized in the direction which moves the shaft 16 deep within the housing 14 by a spring 21 provided on the fuel passage 8 side.

Further, an electromagnetic solenoid 17 is also provided in the housing 14. This electromagnetic solenoid 17 generates an electromagnetic force that acts on the armature 15 and moves it against the spring force of the spring 21. The electromagnetic force that acts on the armature 15 is adjusted by controlling an amount of a current to the electromagnetic solenoid 17 with the ECU 10. The electromagnetic force pushes the armature 15 in a direction so that the shaft 16 moves from deep within the housing 14 toward the fuel passage 8 side.

Therefore, the armature 15 is slid (i.e., displaced) in the axial direction thereof by the spring force from the spring 21 and the electromagnetic force generated by the electromagnetic solenoid 17. This sliding of the armature 15 displaces the valve body 12 within the fuel passage 8, thereby changing the fuel flow area in the fuel passage 8.

Fuel enters the housing 14 from the fuel passage 8 through a hole 22 formed in the valve body 12. This fuel provides lubrication between the housing 14 and the armature 15 when the armature 15 slides in the axial direction. Because the fuel enters the housing 14, fluid chambers 18 and 19 are created in the housing 14 which fill with fuel on both sides of the armature 15 in the direction in which it slides. These fluid chambers 18 and 19 are separated from one another by the armature 15.

When the fluid chambers 18 and 19 are filled with fuel, the fuel within the fluid chambers 18 and 19 may inhibit the armature 15 from sliding. That is, even if there is electromagnetic force acting on the armature 15, the armature 15 is not able to slide in the axial direction unless the fuel flows from the fluid chamber with the smaller capacity to the other fluid chamber. Therefore, a communicating hole 20 is formed in the armature 15 to enable the fuel to flow back and forth between the fluid chambers 18 and 19. Accordingly, the fuel is able to flow between the fluid chambers 18 and 19 through the communicating hole 20, thereby inhibiting the occurrence of the aforementioned problem.

Next, the communicating hole 20 of the armature 15 will be described in detail with reference to FIG. 3 as well as FIG. 2. Two of the communicating holes 20 having the same shape are provided at equidistant intervals around the center axis L of the armature 15. Accordingly, the center of the armature 15 is on the center axis L, thus enabling the armature 15 to rotate smoothly around the center axis L. Further, each of the communicating hole 20 includes a parallel portion 20*a* that extends parallel to the center axis L and which opens to the fluid chamber 19 side, and an angled portion 20*b* that is located closer to the end portion of the armature 15 than the parallel portion 20*a* on the fluid chamber 18 side. The angled portion 20*b* is inclined at a predetermined angle (e.g., 45°) with respect to the parallel portion 20*a*, and opens to the fluid chamber 18 side at an angle to, and to the side of, the center axis L.

Therefore, when the current to the electromagnetic solenoid 17 is controlled to slide the armature 15 to the fluid chamber 19 side, fuel from inside the fluid chamber 19 flows into the parallel portion 20*a* of the communicating hole 20. This fuel then passes through the angled portion 20*b* and flows out from the armature 15 on the fluid chamber 18 side. The fuel then flows out at an angle to, and to the side of, the center axis L of the armature 15, as shown by the arrows in FIG. 3. When the fuel flows out from the armature 15, a reaction force F which works in the direction opposite the direction in which the fuel flows (the direction of fuel flow is indicated by the large arrow in FIG. 4) acts on the inside wall of the communicating hole 20 (i.e., on the parallel portion 20*a*).

When this reaction force F is divided into a radial component Fr (i.e., the component of the reaction force F acting in the radial direction of the armature 15) and an axial component Fs (i.e., the component of the reaction force F acting in the axial direction of the armature 15), the radial component Fr acts in the radial direction at a location away from the center axis L. As a result, the radial component Fr acts on the armature 15 as a force in the direction of rotation around the center axis L. This force in the direction of rotation acts on the armature 15 so that it rotates around the center axis L. Accordingly, uneven wear between the armature 15 and the housing 14 due to the same portion of the armature 15 always sliding against the same portion of the housing 14 when the armature 15 is driven, is able to be minimized.

Figure 5:
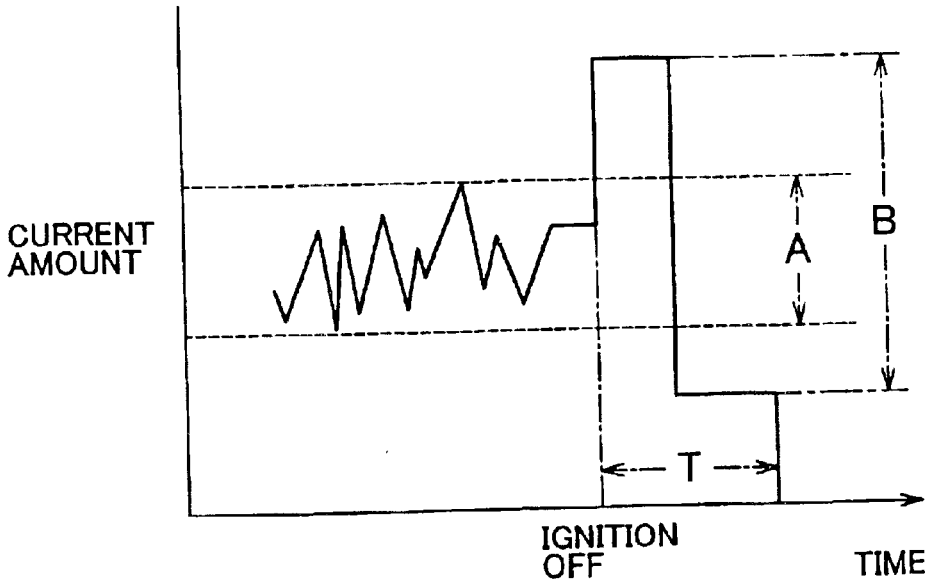
FIG. 5 is a time chart illustrating how the current to an electromagnetic solenoid in the metering valve changes when a diesel engine is shutdown.

Next, forced rotation control that rotates the armature 15 around the center axis L by sliding it in the axial direction will be described with reference to the time chart in FIG. 5. This forced rotation control is executed by controlling the current to the electromagnetic solenoid 17 using the ECU 10.

When the diesel engine 1 is running, the armature 15 is slid in the axial direction by controlling the current to the electromagnetic solenoid 17 so as to obtain a fuel flow quantity in the fuel passage 8 that achieves the predetermined pressure within the common rail 4. When the fuel flow quantity is metered in this way, the current to the electromagnetic solenoid 17 is changed within a predetermined range A so that the armature 15 slides to the fluid chamber 19 side an amount, and at a speed, which does not make it rotate around the center axis L. That is, as long as the current is changed within the predetermined range A, the predetermined range A is set such that the radial component Fr of the reaction force F when the fuel is flowing out from the angled portion 20*b* of the communicating hole 20 on the fluid chamber 18 side does not reach a value that rotates the armature 15.

Then, when the ignition switch 11 is turned off by the driver in order to shutdown the diesel engine 1 when it is running, the forced rotation control that rotates the armature 15 around the center axis L is executed. It should be noted that even after the ignition switch 11 has been turned off, current may be supplied to the electromagnetic solenoid 17 until a predetermined period of time T has passed. During this period of time, the forced rotation control may be executed.

With the forced rotation control, the current to the electromagnetic solenoid 17 is first increased by the ECU 10 so as to temporarily exceed the upper limit value of the predetermined range A to slide the armature 15 to the fluid chamber 18 side. The current is then reduced below the lower limit value of the predetermined range A to obtain an amount of change B to slide the armature 15 to the fluid chamber 19 side. This sliding of the armature 15 allows fuel flowing through the communicating hole 20 to flow from the angled portion 20*b* to outside the armature 15.

By reducing the amount of change B in the current, the armature 15 is slid to the fluid chamber 19 side an amount, and at a speed, such that the armature 15 can rotate around the center axis L by the outflow of fuel passing through the communicating hole 20 from the armature 15. That is, the armature 15 rotates to the fluid chamber 19 side an amount, and at a speed, such that the radial component Fr of the reaction force F acting on the armature 15 when the fuel flows out of the armature 15 becomes equal to, or greater than, a value that rotates the armature 15. With the forced rotation control, when the initial amount of current is increased to temporarily exceed the predetermined range A, the armature 15 is slid to the fluid chamber 18 side so that it can slide back to the fluid chamber 19 side when the current is reduced by the amount of change B.

Executing this forced rotation control rotates the armature 15 around the center axis L and inhibits the armature 15 and housing 14 from sliding against one another always at the same portion, thereby minimizing uneven wear on the housing 14 and particularly on the armature 15.

The exemplary embodiment as described in detail above enables the following effects to be obtained. (1) When the armature 15 slides to the fluid chamber 19 side, fuel within the fluid chamber 19 flows into the parallel portion 20*a* of the communicating hole 20 and then out of the armature 15 from the angled portion 20*b* of the communicating hole 20. Because the angled portion 20*b* is formed at an angle to, and to the side of, the center axis L of the armature 15, the fuel that flows out from the angled portion 20*b* flows out at an angle to, and to the side of, the center axis L. Therefore, when the fuel flows out from the angled portion 20*b*, a force in the direction of rotation around the axis of the armature 15 works precisely on the armature 15. The action of this force in the direction of rotation causes the armature 15 to rotate around the center axis L, which inhibits the armature 15 and housing 14 from always sliding against one another at the same portions, such that uneven wear on the housing 14 and the armature 15 is minimized. Moreover, as uneven wear progresses, it may cause the armature 15 to hang up or the like when the armature 15 slides in the axial direction while the engine is running. This, in turn, makes it difficult to appropriately control the position of the armature 15, which may result in inappropriate metering of the fuel flow quantity in the fuel passage 8. The action of the force in the direction of rotation which causes the armature 15 to rotate around the center axis L enables this inappropriate metering to be minimized. It should be noted that when controlling the idle speed of the diesel engine by adjusting the fuel injection quantity, for example, and the metering of the fuel flow quantity in the fuel passage 8 is inappropriate, the idle speed may not be controlled appropriately and it may begin hunting. The occurrence of this problem is also able to be minimized.

(2) The angled portion 20*b*, through which the fuel that passes through the communicating hole 20 flows out of the armature 15 when the armature 15 slides to the fluid chamber 19 side, opens to the fluid chamber 18 side. Accordingly, the fuel flows smoothly out of the armature 15 from the communicating hole 20 so the force of the fuel passing through the communicating hole 20 increases. As a result, the fuel flowing out from the armature 15 (i.e., flowing out from the angled portion 20*b*) increases the force in the direction of rotation that acts on the armature 15.

(3) When the armature 15 slides to the fluid chamber 19 side, the parallel portion 20*a* of the communicating hole 20 in through which the fuel from the fluid chamber 19 initially flows is parallel to the center axis L of the armature 15, i.e., is parallel to the direction in which the armature 15 slides. Accordingly, the fuel in the fluid chamber 19 flows smoothly into the communicating hole 20, passes through the angled portion 20*b*, and flows out of the armature 15. Because the fuel flows smoothly into the communicating hole 20, the force of the fuel passing therethrough increases. As a result, the fuel flowing out from the armature 15 (i.e., flowing out from the angled portion 20*b*) increases the force in the direction of rotation that acts on the armature 15.

(4) Because a plurality of the communicating holes 20 are formed having the same shape and at equidistant intervals around the center axis L of the armature 15, the center of the armature 15 is able to be positioned on the center axis L thereof. Accordingly, it is easy to rotate the armature 15 around the center axis L, and the armature 15 is able to be rotated with very little force from the outflow of fuel from the angled portion 20*b*. Furthermore, because the fuel flows out from the angled portion 20*b* in a plurality of locations to apply force in the direction of rotation on the armature 15, the force in that direction increases, making it is easier to rotate the armature 15.

(5) When the diesel engine 1 is running, and the armature 15 is slid in the axial direction to meter the fuel flow quantity in the fuel passage 8 with the metering valve 9, the current to the electromagnetic solenoid 17 is controlled within the predetermined range A such that the armature 15 is slid an amount, and at a speed, where it does not rotate around the center axis L. On the other hand, when the ignition switch 11 is turned off to begin shutdown of the diesel engine 1, the forced rotation control is executed to rotate the armature 15 around the center axis L by sliding it to the fluid chamber 19 side. In this forced rotation control, the current to the electromagnetic solenoid 17 is reduced by only the amount of change B that is greater than the difference between the upper limit value and the lower limit value of the predetermined range A. As a result, it is possible to accurately rotate the armature 15 around the center axis L by sliding the armature 15 to the fluid chamber 19 side according to that reduction in current to the electromagnetic solenoid 17. Accordingly, the armature 15 is only able to be forcibly rotated around the center axis L when the ignition switch 11 is turned off by the driver. If the armature 15 is rotated around the center axis L when the engine is running and the fuel flow quantity is metered by the metering valve 9, the armature would rotate as it is moved. As a result, there is a possibility that friction from the rotation would have an adverse effect on the control of movement of the armature 15 in the axial direction. This adverse effect is able to be avoided, however, by limiting the execution of the forced rotation control only to the start of engine shutdown, at which time the metering valve 9 does not meter the fuel flow quantity.

Figure 6:
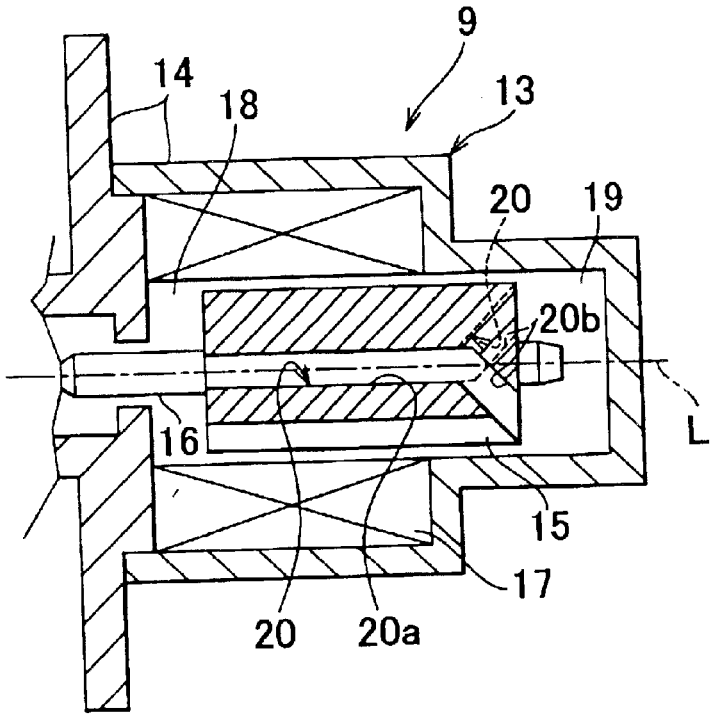
FIG. 6 is a cross-sectional view of a portion of the actuator in the metering valve, showing an example in which the communicating hole has another shape.
Figure 7:
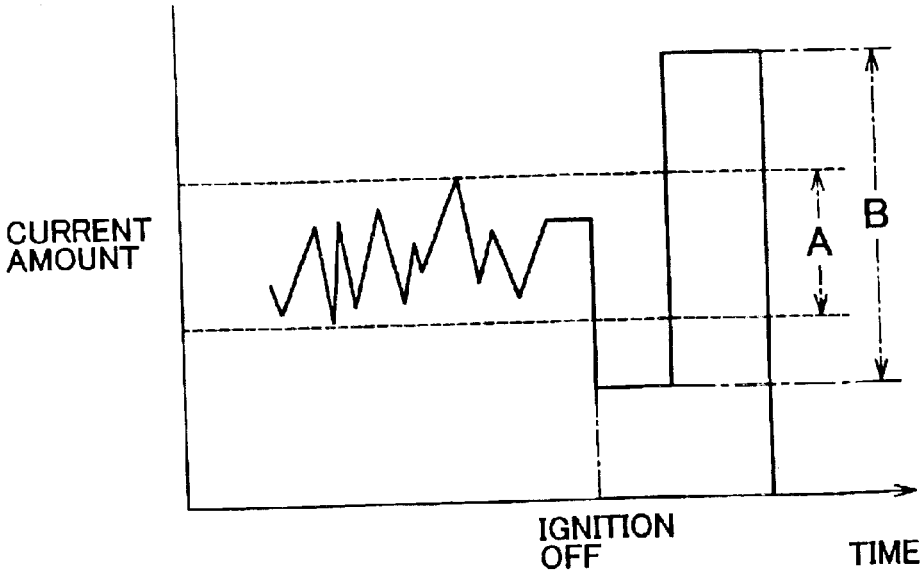
FIG. 7 is a time chart illustrating how the current to the electromagnetic solenoid in the metering valve changes when the diesel engine is shutdown.

This exemplary embodiment may be modified as follows, for example. As shown in FIG. 6, the parallel portion 20*a* of the communicating hole 20 may open to the fluid chamber 18 side and the angled portion 20*b*, rather than the parallel portion 20*a*, of the communicating hole 20 may be on the fluid chamber 19 side. In this case, as opposed to the foregoing exemplary embodiment, when the armature 15 slides to the fluid chamber 18 side, the fuel inside the fluid chamber 18 flows into the parallel portion 20*a* and flows out of the angled portion 20*b*. Accordingly, with the forced rotation control, as shown in FIG. 7, when the ignition switch 11 is turned off, the current to the electromagnetic solenoid 17 is first temporarily decreased below the lower limit value of the predetermined range A such that the armature 15 slides to the fluid chamber 19 side. Then, the current is increased beyond the upper limit value of the predetermined range A to obtain the amount of change B such that the armature 15 slides to the fluid chamber 18 side. When the armature 15 is slid, the fuel passing through the communicating hole 20 flows out of the armature 15 from the angled portion 20*b* and rotates the armature 15 around the center axis L.

Further, instead of executing the forced rotation control when the ignition switch 11 is turned off to begin engine shutdown (i.e., when the armature 15 stops being driven), it may be executed when the ignition switch II is turned on to begin engine startup (i.e., when the armature 15 starts to be driven). In this case, because the forced rotation control is only executed when engine startup begins, at which time the metering valve 9 does not meter the fuel flow quantity, it is possible to avoid an adverse effect such as that indicated in (4) above. The procedure when the forced rotation control is executed will be described in detail below.

Figure 2:
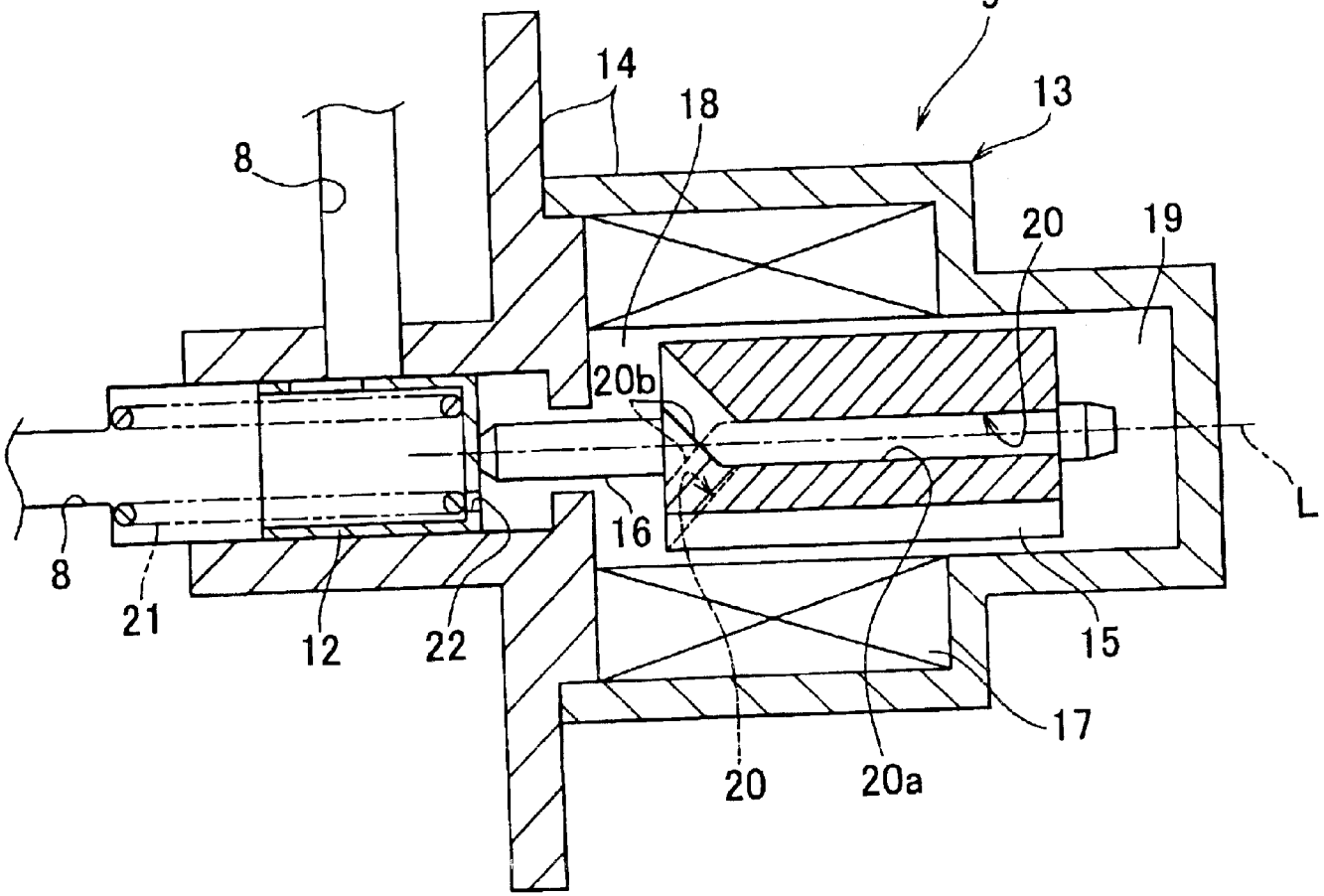
FIG. 2 is a cross-sectional view showing the internal structure of the metering valve.
Figure 3:
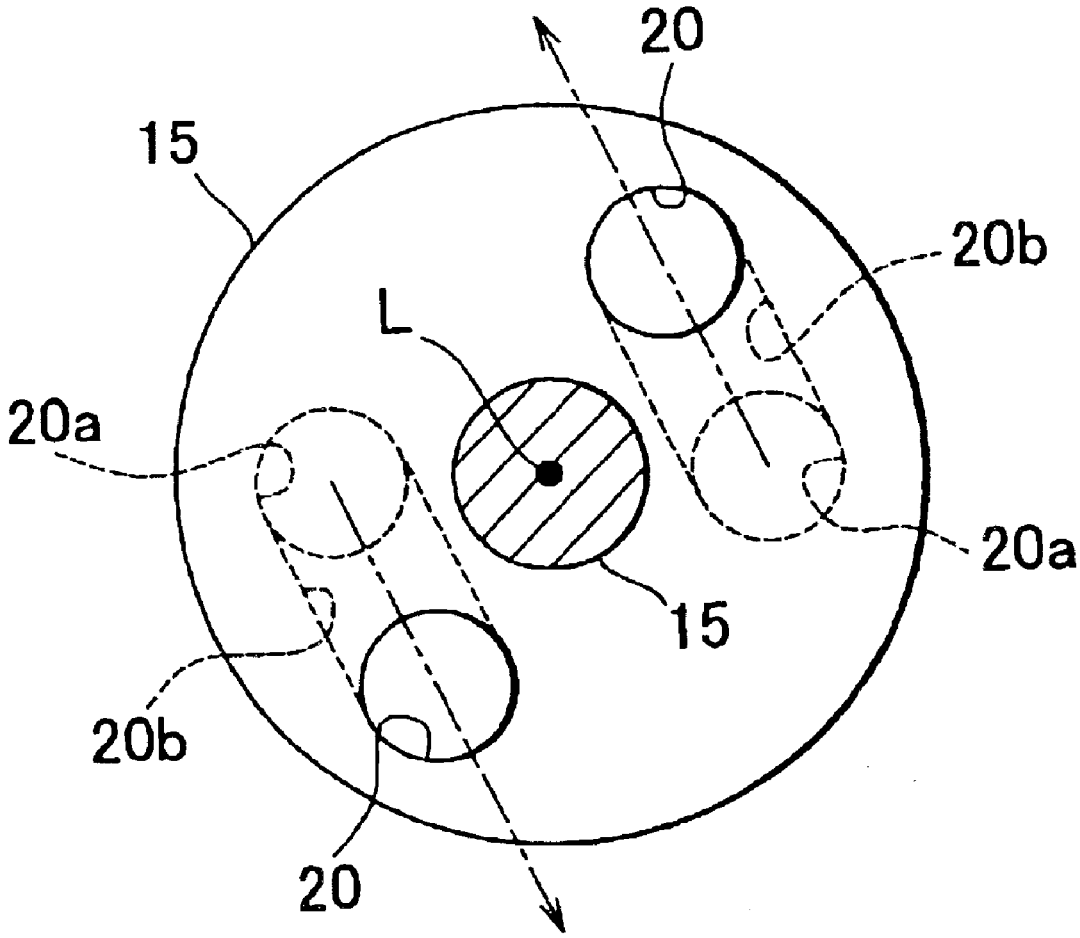
FIG. 3 is a front view showing an armature used in the metering valve shown in FIG. 2.
Figure 4:
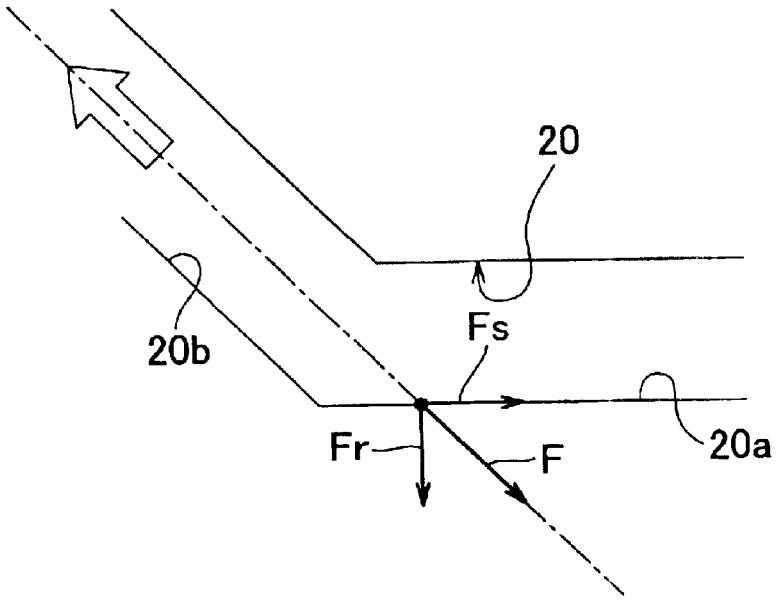
FIG. 4 is an explanatory view illustrating the force that works on the armature when fuel passes through a communicating hole formed in the armature.
Figure 8:
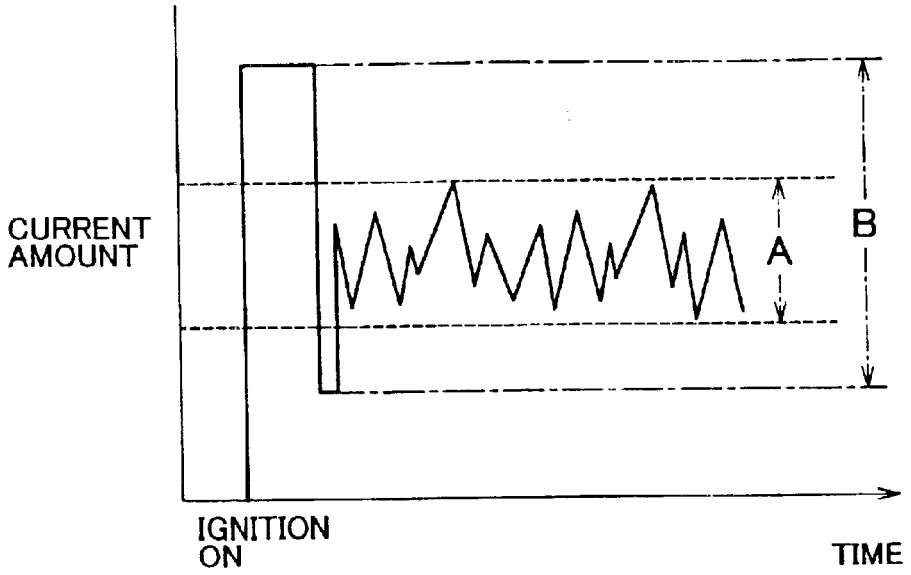
FIG. 8 is a time chart illustrating how the current to the electromagnetic solenoid in the metering valve changes when the diesel engine is started up.

When the communicating hole 20 of the armature 15 is formed as shown in FIG. 2 and the ignition switch 11 is turned on, the current to the electromagnetic solenoid 17 is increased to temporarily exceed the upper limit value of the predetermined range A, and then decreased below the lower limit value of the predetermined range A to obtain the amount of change B, for example, as shown in FIG. 8. When the armature 15 slides to the fluid chamber 19 side due to this increase and decrease in this current, the armature 15 rotates around the center axis L.

Figure 9:
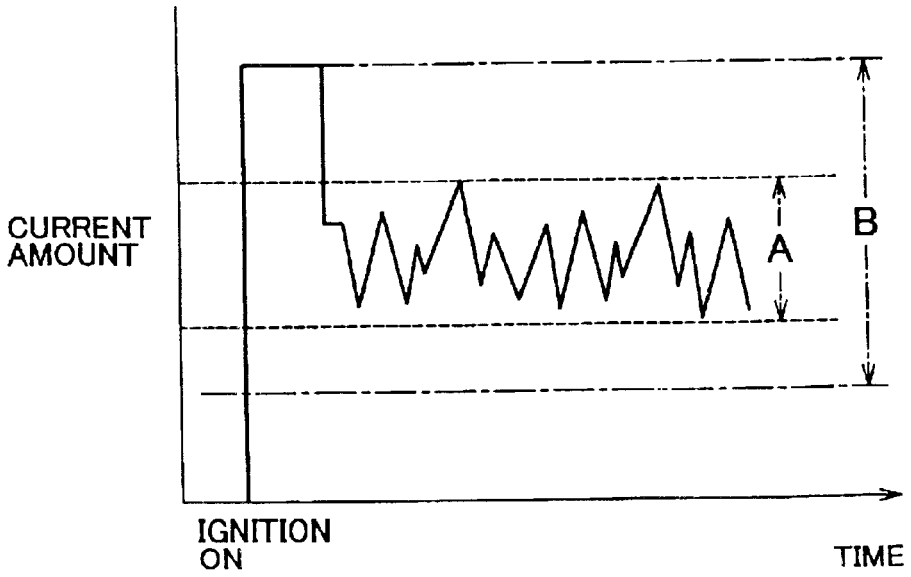
FIG. 9 is a time chart illustrating how the current to the electromagnetic solenoid in the metering valve changes when the diesel engine is started up.

Also, when the communicating hole 20 of the armature 15 is formed as shown in FIG. 6 and the ignition switch 11 is turned on, the current to the electromagnetic solenoid 17 increases from "0" by an amount of change equal to, or greater than, the amount of change B, as shown in FIG. 9, so as to exceed the upper limit value of the predetermined range A. When the armature 15 slides to the fluid chamber 18 side due to this increase in the current, the armature 15 rotates around the center axis L.

After the forced rotation control is executed in this manner, the current value is changed within the predetermined range A according to the fuel flow quantity required in the fuel passage 8. The forced rotation control may be executed both when the ignition switch 11 is turned on and when the ignition switch 11 is turned off.

Figure 10:
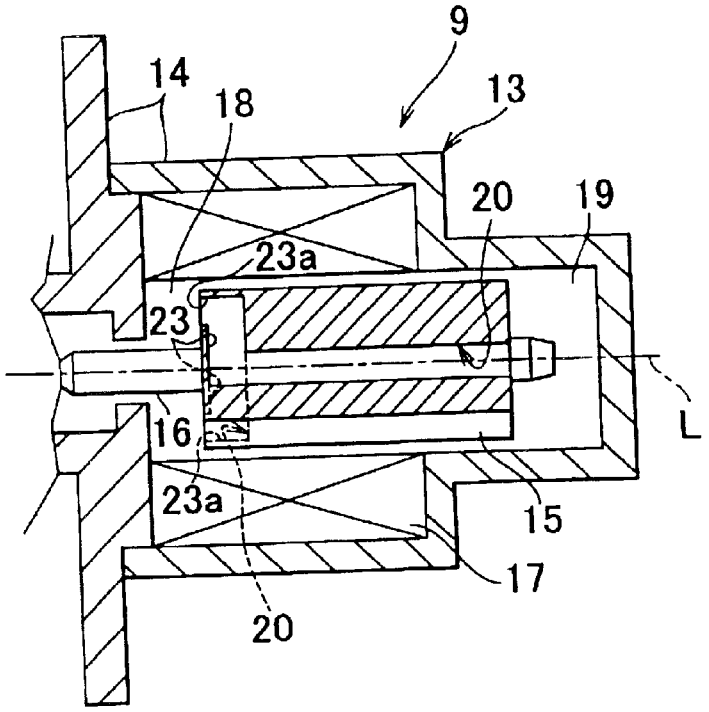
FIG. 10 is a cross-sectional view of a portion of the actuator in the metering valve, showing an example in which the communicating hole has another shape.
Figure 11:
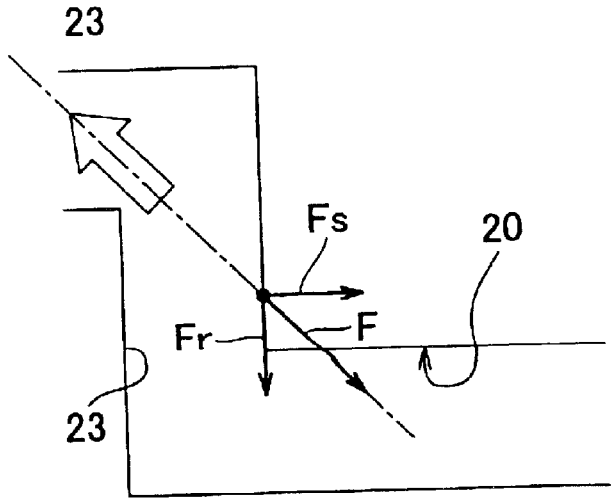
FIG. 11 is an explanatory view illustrating the force that works on the armature when fuel passes through the communicating hole.
Figure 12:
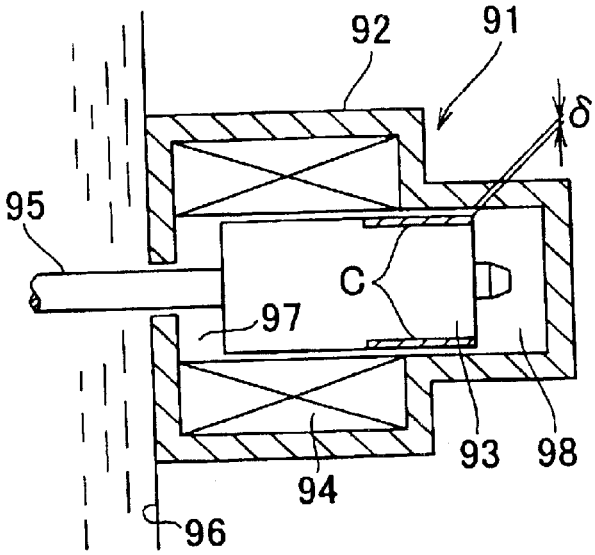
FIG. 12 is a cross-sectional view showing, as an example of related art, a portion of an actuator in a metering valve.
Figure 13:
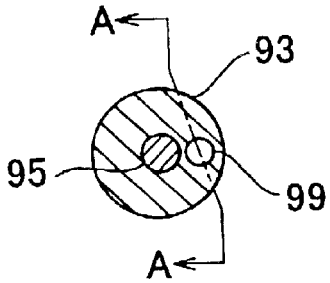
FIG. 13 is a cross-sectional view of an armature used in the actuator shown in FIG. 12.
Figure 14:
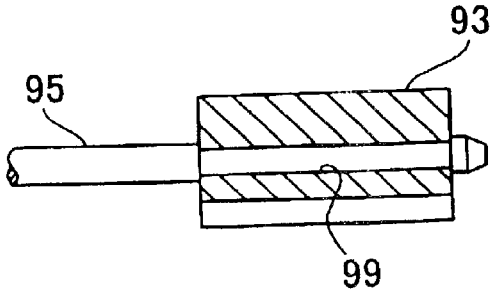
FIG. 14 is a cross-sectional view of the armature shown in FIG. 13 as viewed from the direction of arrow A—A.

The shape of the communicating hole 20 may be modified appropriately as long as the fuel in the communicating hole 20 which flows out from the angled portion 20*b* when the armature 15 is slid to the fluid chamber 19 side flows out at an angle, and to the side of, the center axis L of the armature 15. For example, as shown in FIG. 10, an end portion 23 on the fluid chamber 18 side of the communicating hole 20 may be bent 90 degrees with respect to the center axis L near the end face of the armature 15, and that end portion 23 may form an open portion 23*a* that opens at the end face of the armature 15. In this case as well, the fuel flowing from the open portion 23*a* to the fluid chamber 18 flows out at an angle with respect to the center axis L of the armature 15. When the fuel flows out, the reaction force F that acts in the direction opposite the direction in which the fuel flows (the direction in which the fuel flows is shown by the large arrow in FIG. 11) acts on the inside wall of the end portion 23 of the communicating hole 20. The radial component Fr of this reaction force F works on the armature 15 as a force in the direction of rotation around the center axis L, such that the armature 15 rotates around the center axis L.

Furthermore, the number of communicating hole 20 may be changed appropriately. Each of the communicating hole 20 need not have the same shape, nor must the communicating holes 20 be formed at equidistant intervals around the center axis L. In this case, it is preferable that the shape and position of each of the communicating holes 20 be such that the center of the armature 15 is positioned on the center axis L.

In the foregoing exemplary embodiment, this invention is applied to a metering valve 9 provided in a fuel supply system of a diesel engine 1. Alternatively, however, the invention may be applied to a metering valve provided in a fuel supply system on a gasoline engine.

Further, the invention may be applied to an electromagnetic value other than the metering valve 9. Also, the invention may be applied to a valve other than an electromagnetic valve as long as an actuator is provided that moves the armature using electromagnetic force.

What is claimed is:

1. A driving device for an armature which is slidably provided within a housing filled with a fluid and which divides an inside of the housing into two fluid chambers, comprising a communicating hole enabling the fluid to pass between the two fluid chambers, wherein the communicating hole is formed such that the fluid passing through the communicating hole and out from the armature when the armature slides flows out at an angle to, and to the side of, a center axis of the armature, the driving device comprising:

a controller that changes an amount of current supplied to an electromagnetic solenoid that generates an electromagnetic force to drive the armature, the controller changes the amount of current supplied to the electromagnetic solenoid at a first predetermined timing and imparts a force to the armature which is based on the outflow of the fluid, and which is able to rotate the armature in a direction of rotation around a center axis of the armature, wherein the armature is slidably provided within a housing filled with a fluid and which divides an inside of the housing into two fluid chambers, and the change in the amount of current supplied to the electromagnetic solenoid at the first predetermined timing is larger than a difference between an upper limit value and a lower limit value of a control range of the amount of current between the time when the armature starts to be driven and the time when the armature stops being driven.

2. The driving device according to claim 1, wherein the armature is used in a metering valve that is provided in a fuel supply system of an internal combustion engine.

3. The driving device according to claim 2, wherein the controller controls the amount of current supplied to the electromagnetic solenoid within the control range when the internal combustion engine is running, and makes the change in the amount of current supplied to the electromagnetic solenoid larger than the difference between the upper limit value and the lower limit value of the control range at a second predetermined timing.

4. The driving device according to claim 3, wherein the second predetermined timing is at the beginning of startup of the internal combustion engine when an ignition switch is turned on.

5. The driving device according to claim 3, wherein the second predetermined timing is at the beginning of shutdown of the internal combustion engine when an ignition switch is turned off.

6. A method of regulating movement of an armature slidably provided in a housing filled with a fluid and that divides an inside of the housing into two fluid chambers in the housing, comprising:

controlling an amount of current supplied to an electromagnetic solenoid that communicates with the armature;

changing the amount of current supplied to the electromagnetic solenoid at a first predetermined time to impart a force to the armature based on an outflow of the fluid through a communicating hole in the armature;

enabling the fluid to pass through the communicating hole and between the two fluid chambers, such that the fluid passes through the communicating hole and out from the armature when the armature slides and flows out at an angle to, and to the side of, a center axis of the armature; and rotating the armature in a direction of rotation around the center axis of the armature, wherein the change in the amount of current supplied to the electromagnetic solenoid at the first predetermined timing is larger than a difference between an upper limit value and a lower limit value of a control range of the amount of current between the time when the armature starts to be driven and the time when the armature stops being driven.

7. The method according to claim 6, wherein the armature is used in a metering valve that is provided in a fuel supply system of an internal combustion engine.

8. The method according to claim 7, wherein the controller controls the amount of current supplied to the electromagnetic solenoid within the control range when the internal combustion engine is running, and makes the change in the amount of current supplied to the electromagnetic solenoid larger than the difference between the upper limit value and the lower limit value of the control range at a second predetermined timing.

9. The method according to claim 8, wherein the second predetermined timing is at the beginning of startup of the internal combustion engine when an ignition switch is turned on.

10. The method according to claim 8, wherein the second predetermined timing is at the beginning of shutdown of the internal combustion engine when an ignition switch is turned off.

* * * * *